US008474072B2

(12) United States Patent
O'Keefe et al.

(10) Patent No.: US 8,474,072 B2
(45) Date of Patent: Jul. 2, 2013

(54) HOSPITAL BED WITH CHAIR LOCKOUT

(75) Inventors: Christopher R. O'Keefe, Batesville, IN (US); Jason A. Penninger, Indianapolis, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 353 days.

(21) Appl. No.: 12/891,909

(22) Filed: Sep. 28, 2010

(65) Prior Publication Data

US 2012/0073054 A1 Mar. 29, 2012

(51) Int. Cl.
*A47B 71/00* (2006.01)

(52) U.S. Cl.
USPC ..... 5/600; 5/618; 340/4.11; 340/286.07; 340/573.1

(58) Field of Classification Search
USPC ..... 5/600, 613, 616, 617, 618; 340/539.12, 340/286.07, 4.11, 573.1
See application file for complete search history.

(56) References Cited

U.S. PATENT DOCUMENTS 4,044,286 A 8/1977 Adams et al.
5,715,548 A * 2/1998 Weismiller et al. ..... 5/624
5,771,511 A 6/1998 Kummer et al.
5,802,640 A 9/1998 Ferrand et al.
5,906,016 A 5/1999 Ferrand et al.
5,906,017 A 5/1999 Ferrand et al.
6,000,076 A 12/1999 Webster et al.
6,163,903 A 12/2000 Weismiller et al.
6,208,250 B1 3/2001 Dixon et al.
6,226,816 B1 5/2001 Webster et al.
6,279,183 B1 8/2001 Kummer et al.
6,336,235 B1 1/2002 Ruehl
6,438,776 B2 8/2002 Ferrand et al.
6,611,979 B2 9/2003 Welling et al.
6,658,680 B2 12/2003 Osborne et al.
6,668,408 B2 12/2003 Ferrand et al.
6,691,346 B2 2/2004 Osborne et al.
6,791,460 B2 9/2004 Dixon et al.
6,880,189 B2 4/2005 Welling et al.
6,941,598 B2 9/2005 Ferrand et al.
6,957,461 B2 10/2005 Osborne et al.
6,978,500 B2 12/2005 Osborne et al.
7,017,208 B2 3/2006 Weismiller et al.
7,154,397 B2 * 12/2006 Zerhusen et al. ..... 340/573.1
7,171,708 B2 2/2007 Osborne et al.
7,237,287 B2 7/2007 Weismiller et al.
7,296,312 B2 11/2007 Menkedick et al.
7,310,839 B2 12/2007 Salvatini et al.
7,319,386 B2 1/2008 Collins, Jr. et al.
7,454,805 B2 11/2008 Osborne et al.
7,472,439 B2 1/2009 Lemire et al.

(Continued)

*Primary Examiner* — Robert G Santos
*Assistant Examiner* — Nicholas Polito
(74) *Attorney, Agent, or Firm* — Barnes & Thornburg LLP

(57) ABSTRACT

A patient support apparatus includes a frame and a mattress support deck coupled to the frame. The mattress support deck is movable between a horizontal position to support a patient in a lying position and a chair egress position to support the patient in a sitting position. The patient support apparatus has at least one actuator coupled to the mattress support deck and operable to move the mattress support deck between the horizontal position and the chair egress position. Control circuitry is coupled to the at least one actuator and is operable to command operation of the at least one actuator. In response to the control circuitry receiving a chair lockout signal, the at least one actuator is prevented from being operated to move the mattress support deck into the chair egress position.

18 Claims, 6 Drawing Sheets

U.S. PATENT DOCUMENTS

| | | | | |
|---|---|---|---|---|
| 7,480,951 | B2 | 1/2009 | Weismiller et al. | |
| 7,506,390 | B2 | 3/2009 | Dixon et al. | |
| 7,520,006 | B2 | 4/2009 | Menkedick et al. | |
| 7,533,429 | B2 | 5/2009 | Menkedick et al. | |
| 7,568,246 | B2 | 8/2009 | Weismiller et al. | |
| 7,583,659 | B2 | 9/2009 | Matsuhashi et al. | |
| 7,610,637 | B2 | 11/2009 | Menkedick et al. | |
| 7,653,954 | B2 | 2/2010 | Hornbach et al. | |
| 7,669,263 | B2 | 3/2010 | Menkedick et al. | |
| 7,679,520 | B2 | 3/2010 | Zerhusen et al. | |
| 7,690,059 | B2 | 4/2010 | Lemire et al. | |
| 7,702,481 | B2 | 4/2010 | Dionne et al. | |
| 7,703,158 | B2 | 4/2010 | Wilker, Jr. et al. | |
| 7,779,493 | B2 * | 8/2010 | Lemire et al. | 5/600 |
| 7,784,128 | B2 | 8/2010 | Kramer | |
| 7,805,784 | B2 | 10/2010 | Lemire et al. | |
| 7,849,545 | B2 | 12/2010 | Flocard et al. | |
| 7,882,582 | B2 * | 2/2011 | Kappeler et al. | 5/600 |
| 2007/0180616 | A1 | 8/2007 | Newkirk et al. | |
| 2007/0210917 | A1 | 9/2007 | Collins et al. | |
| 2008/0235872 | A1 | 10/2008 | Newkirk et al. | |
| 2009/0212925 | A1 | 8/2009 | Schuman, Sr. et al. | |
| 2009/0212926 | A1 | 8/2009 | Du et al. | |
| 2009/0217080 | A1 | 8/2009 | Ferguson et al. | |

* cited by examiner

HOSPITAL BED WITH CHAIR LOCKOUT

BACKGROUND

The present disclosure relates to patient support apparatuses such as hospital beds, for example. More particularly, the present disclosure relates to patient support apparatuses having mattress support decks with sections that are moved by actuators.

Patient support apparatuses such as hospital beds, stretchers, wheelchairs, surgical tables, and the like oftentimes have mattress support decks with movable sections. Actuators or motors, such as linear actuators or hydraulic cylinders, are used to move the movable sections of mattress support decks on many prior art patient support apparatuses. In some instances, it is not desirable for patients to be moved in a particular manner while resting on a patient support apparatus. For example, after abdominal surgery there may be a period of time when a patient should remain in a supine position and not moved to a sitting up position.

Some prior art patient support apparatus have user inputs that are used to lock out the use of the actuators. See, for example, U.S. Pat. Nos. 6,279,183; 6,226,816; 6,208,250; 5,771,511 and 4,044,286. In the prior art patient support apparatuses, the actuators for articulating the sections of a mattress support deck are only able to be locked out individually via use of lock out inputs dedicated to the individual actuators. However, in some instances, such as with regard to a pair of actuators of an elevation system of a patient support apparatus, multiple actuators on the patient support apparatus may be locked out together but these are typically not the actuators associated with deck articulation.

SUMMARY

The present invention comprises one or more of the features recited in the appended claims and/or the following features which, alone or in any combination, may comprise patentable subject matter:

A patient support apparatus may have a frame and a mattress support deck coupled to the frame. The mattress support deck may be movable between a horizontal position to support a patient in a lying position and a chair egress position to support the patient in a sitting position. The patient support apparatus may also have at least one actuator coupled to the mattress support deck and operable to move the mattress support deck between the horizontal position and the chair egress position. Control circuitry may be coupled to the at least one actuator and operable to command operation of the at least one actuator. The control circuitry may be operable to receive a chair lockout signal and, in response to receipt of the chair lockout signal, the control circuitry may operate to prevent the at least one actuator from being operated to move the mattress support deck into the chair egress position.

The patient support apparatus may include a chair lockout user input. The chair lockout signal may be sent to the control circuitry in response to use of the chair lockout user input by a user. The chair lockout user input may include a button that is pressed by the user, a membrane switch, and/or a field on a touch screen display. The patient support apparatus may have a barrier coupled to one of the frame and the mattress support deck. The barrier may inhibit movement of a patient off of the patient support apparatus. The chair lockout user input may be coupled to the barrier. The barrier may comprise one of a siderail, a head board, and a foot board.

The chair lockout signal may be sent to the control circuitry by a computer device located remotely from the patient support apparatus. For example, the computer device may be included as part of an electronic medical record (EMR) system. The chair lockout signal may be sent to the control circuitry automatically by the computer device in response to the computer device receiving information indicative of a patient condition that is incompatible with moving the patient into a sitting position. The information indicative of the patient condition may include, for example, information indicating that the patient is going to have, or has had, abdominal surgery.

The mattress support deck may include a head section and a foot section. The at least one actuator may include a first actuator operable to move the head section and a second actuator operable to move the foot section. Receipt of the chair lockout signal by the control circuitry may result in the control circuitry preventing simultaneous operation of the first and second actuators. The first actuator and the second actuator may each be operable individually even if the control circuitry has received the chair lockout signal unless the first and second actuators have been locked out individually. However, the control circuitry may operate to prevent individual operation of the first actuator in response to receipt of a first lockout signal and the control circuitry may operate to prevent individual operation of the second actuator in response to receipt of a second lockout signal. Thus, the patient support apparatus may have a first lockout user input that is used to lockout the first actuator individually and a second lockout user input that is used to lockout the second actuator individually.

The frame may include a base, an upper frame above the base, and a lift system to raise and lower the upper frame relative to the base between a low position and a high position. The lift system may move the upper frame to the low position during movement of the mattress support deck to the chair egress position. The control circuitry also may operate to prevent the lift system from moving the upper frame when the control circuitry is locked out from moving the mattress support deck to the chair egress position.

The lift system may be operable individually even if the control circuitry has received the chair lockout signal unless the lift system has been locked out individually. However, the control circuitry may operate to prevent individual operation of the lift system in response to receipt of a lift system lockout signal. Thus, the patient support apparatus may further include a lift system lockout user input that is used to lockout the lift system individually. The lift system may include a plurality of lift actuators and use of the lift system lockout user input may result in the control circuitry locking out all of the plurality of lift actuators from individual operation.

According to this disclosure, an actuator may be considered to be locked out if the actuator is disconnected such as by opening a switch in a connection between the actuator and a power source, or if a user input is ignored by software that controls operation of the actuator, or if a user input is disconnected such as by opening a switch in a connection between the switch and control circuitry, or combinations of these scenarios. Thus, an actuator may be locked out via hardware or via software according to this disclosure.

Additional features, which alone or in combination with any other feature(s), such as those listed above and those listed in the claims, may comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures in which.

DETAILED DESCRIPTION

According to this disclosure, a patient support apparatus, such as an illustrative hospital bed 10, is configured with a chair lockout user input 138, 158 that prevents simultaneous movement of multiple actuators that are otherwise actuated to move a mattress support deck, along with any mattress supported thereon, into a chair egress position. However, each of the actuators is still able to be moved individually unless the actuators have been separately and individually locked out. Thus, according to this disclosure, the chair lockout function locks out the combined and/or simultaneous movement of a particular set of actuators on the hospital bed.

Figure 1:
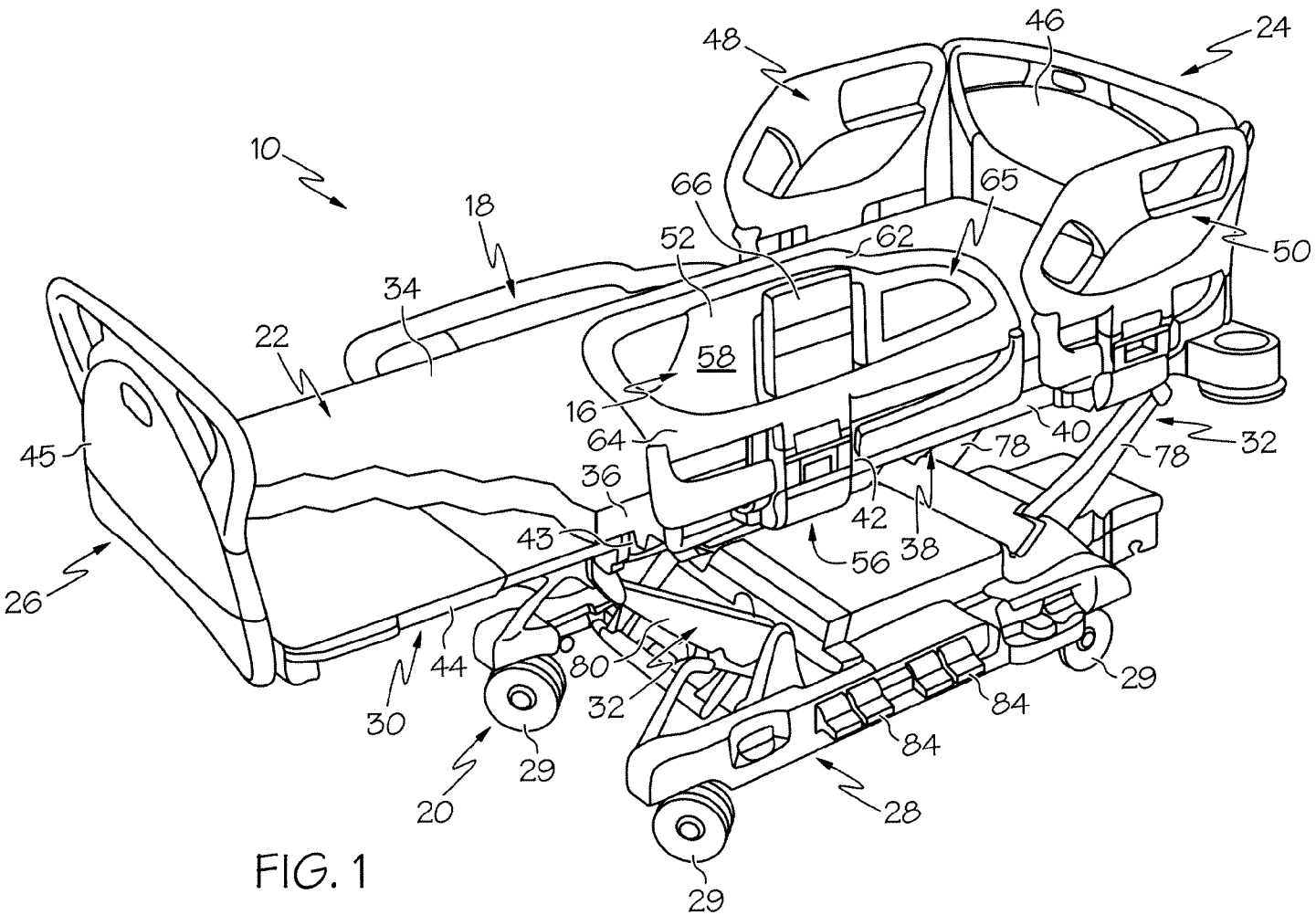
FIG. 1 is a perspective view of a hospital bed showing a bed frame having a patient support deck supporting a mattress in a horizontal position.
Figure 2:
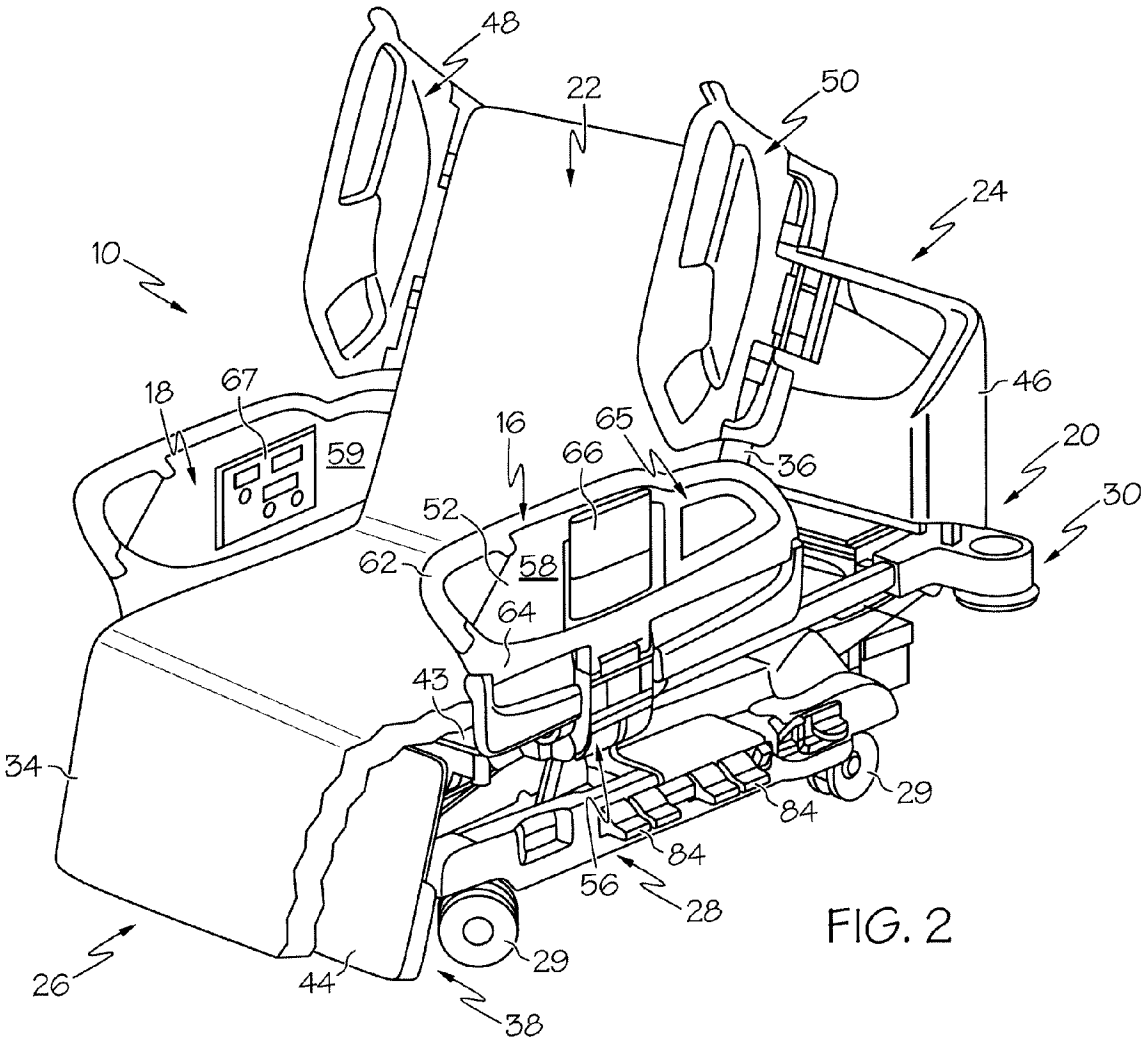
FIG. 2 is a perspective view of the hospital bed of FIG. 1 showing the patient support deck of the bed frame moved to a chair egress position.

Illustrative bed 10 is a so-called chair bed that is movable between a bed position as shown in FIG. 1 and a chair egress position as shown in FIG. 2. However, the teachings of this disclosure are applicable to other types of patient support apparatuses such as stretchers, motorized chairs, operating room (OR) tables, specialty surgical tables such as orthopedic surgery tables, examination tables, and the like.

Referring now to FIGS. 1 and 2, hospital bed 10 provides support to a patient (not shown) lying in a horizontal position when bed 10 is in the bed position shown in FIG. 1. In the chair egress position, hospital bed 10 supports the patient in a sitting position such that the patient sits on bed 10 with the patient's feet positioned on an underlying floor. Thus, the chair egress position is often used by patients and caregivers to help patients egress or exit the hospital bed 10. Hospital bed 10 includes a frame 20 that supports a mattress 22 as shown in FIGS. 1 and 2. Bed 10 has a head end 24 and a foot end 26.

Frame 20 includes a base 28 and an upper frame 30 coupled to the base 28 by a lift system 32. Lift system 32 is operable to raise, lower, and tilt upper frame 30 relative to base 28. Hospital bed 10 further includes a footboard 45 at the foot end 26 and a headboard 46 at the head end 24. Footboard 45 is removed prior to bed 10 being moved into the chair egress position as shown in FIG. 2. Illustrative bed 10 includes a pair of push handles 47 coupled to upper frame 30 at the head end 24 of bed 10. Base 28 includes wheels or casters 29 that roll along floor (not shown) as bed 10 is moved from one location to another.

Illustrative hospital bed 10 has four siderail assemblies coupled to upper frame 30: a patient-right head siderail assembly 48, a patient-right foot siderail assembly 18, a patient-left head siderail assembly 50, and a patient-left foot siderail assembly 16. Each of the siderail assemblies 16, 18, 48, and 50 is movable between a raised position, as the left foot siderail assembly 16 is shown in FIG. 1, and a lowered position, as the right foot siderail assembly 18 is shown in FIG. 1. Siderail assemblies 16, 18, 48, 50 are sometimes referred to herein as siderails 16, 18, 48, 50.

The left foot siderail assembly 16 is similar to the right foot siderail assembly 18, and thus, the following discussion of the left foot siderail assembly 16 is equally applicable to the right foot siderail assembly 18. The left foot siderail 16 includes a barrier panel 52 and a linkage 56. Linkage 56 is coupled to the upper frame 30 and is configured to guide barrier panel 52 during movement of the foot siderail 16 between the raised and lowered positions. Barrier panel 52 is maintained by the linkage 56 in a substantially vertical orientation during movement of siderail 16 between the raised and lowered positions. The barrier panel 52 includes an outward side 58, an oppositely facing inward side 59, a top portion 62, and a bottom portion 64.

A user interface 66 is coupled to the outward side 58 of barrier panel 52 for use by a caregiver (not shown). Additional details of user interface 66 are discussed below in connection with FIG. 4. The inward side 59 faces opposite the outward side 58. As shown in FIG. 2, another user interface 67 is coupled to the inward side 59 for use by the patient 11. In the illustrative embodiment, a separate caregiver user interface 65 is provided on the outward side 58 of barrier panel 52. Additional details of user interface 65 are discussed below in connection with FIG. 3.

Mattress 22 includes a top surface 34, a bottom surface (not shown), and a perimeter surface 36 as shown in FIGS. 1 and 2. The upper frame 30 carries a patient support deck 38 of frame 20 that engages the bottom surface of mattress 22. The support deck 38, as shown in FIG. 1 and as shown diagrammatically in FIG. 6, includes a head section 40, a seat section 42, a thigh section 43 and a foot section 44. Sections 40, 43, 44 are each movable relative to upper frame 30. For example, head section 40 pivotably raises and lowers relative to seat section 42 whereas foot section 44 pivotably raises and lowers relative to thigh section 43. Additionally, thigh section 43 articulates relative to seat section 42. Also, in some embodiments, foot section 44 includes is extendable and retractable to change the overall length of foot section 44 and therefore, to change the overall length of deck 38. For example, foot section 44 includes a main portion 45 and an extension 47 in some embodiments as shown diagrammatically in FIG. 6.

In some embodiments, seat section 42 also moves, such as by translating on upper frame 30 as bed 10 moves between the bed position and the chair egress position. Of course, in those embodiments in which seat section 42 translates along upper frame 42, the thigh and foot sections 43, 44 also translate along with seat section 42. As bed 10 moves from the bed position to the chair egress position, foot section 44 lowers relative to thigh section 43 and shortens in length due to retraction of the extension 47 relative to main portion 45. As bed 10 moves from the chair egress position to the bed position, foot section 44 raises relative to thigh section 43 and increases in length due to extension of the extension relative to main portion 45. Thus, in the chair egress position, head section 40 extends generally vertically upwardly from upper frame 30 and foot section extends generally vertically downwardly from thigh section 43 as shown in FIG. 2.

Figure 6:
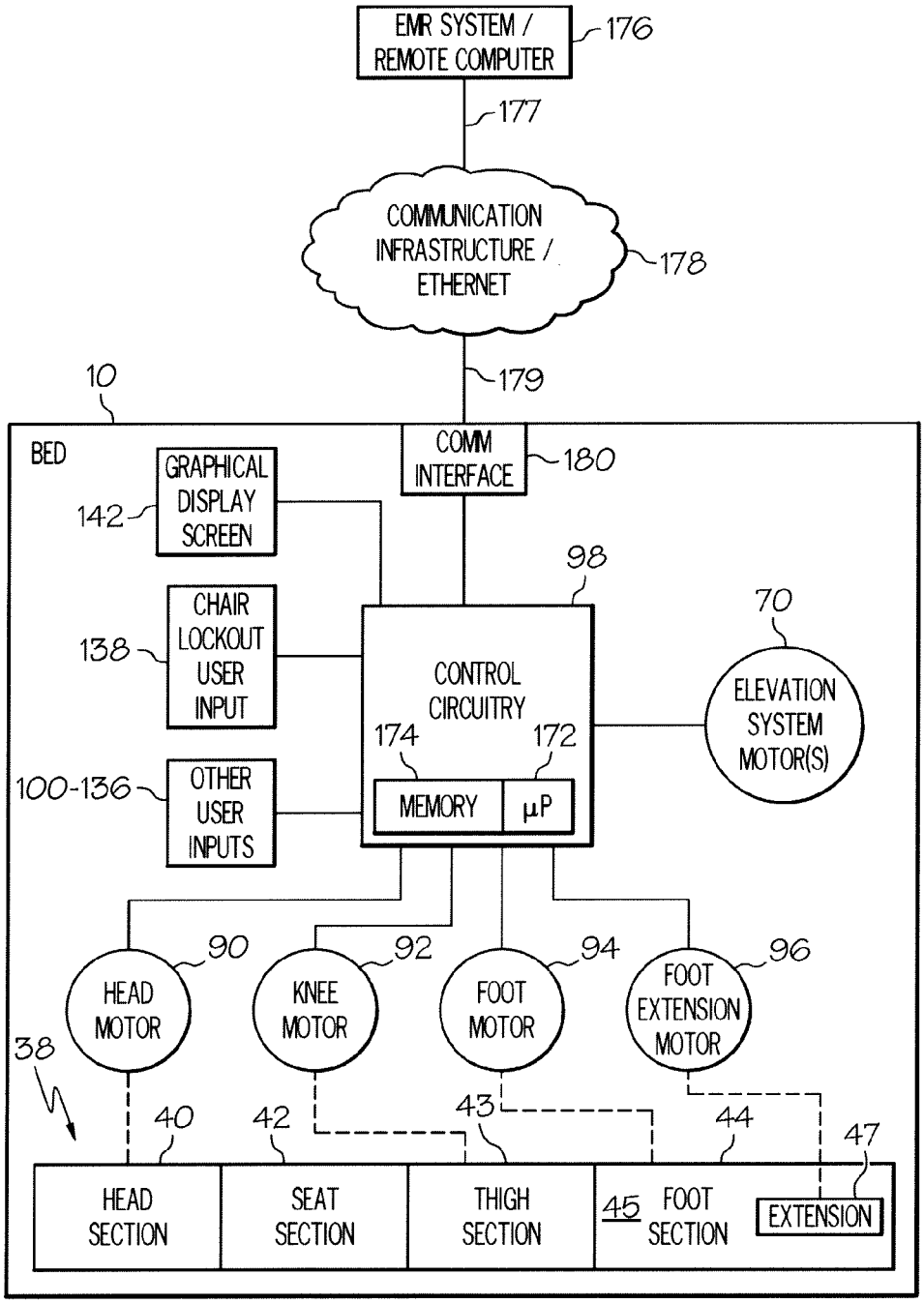
FIG. 6 is a simplified block diagram showing the electrical circuitry of the hospital bed and showing a remote computer coupled to the electrical circuitry of the hospital bed via communication infrastructure.

As shown diagrammatically in FIG. 6, bed 10 includes a head motor or actuator 90 coupled to head section 40, a knee motor or actuator 92 coupled to thigh section 43, a foot motor or actuator 94 coupled to foot section 44, and a foot extension motor or actuator 96 coupled to foot extension 47. Motors 90, 92, 94, 96 may include, for example, an electric motor of a linear actuator. In those embodiments in which seat section 42 translates along upper frame 30 as mentioned above, a seat motor or actuator (not shown) is also provided. Head motor 90 is operable to raise and lower head section 40, knee motor 92 is operable to articulate thigh section 43 relative to seat section 42, foot motor 94 is operable to raise and lower foot section 44 relative to thigh section 43, and foot extension motor 96 is operable to extend and retract extension 47 of foot section 44 relative to main portion 44 of foot section 44.

In some embodiments, bed 10 includes an integrated air system that controls inflation and deflation of various air bladders or cells (not shown) of mattress 22. In response to use of one or more of motors 90, 92, 94, 96 one or more of the bladders of mattress 22 may be inflated or deflated. In some embodiments, for example, in response to raising head section 40, the integrated air system inflates one or more bladders supported above seat section 42 to prevent or lessen the chance of the patient bottoming out on the seat section. Bottoming out refers to the situation in which a patient completely crushes or deforms a mattress bladder to the extent that the patient feels the underlying deck section. As another example, in some embodiments, in response to extension 47 being retracted relative to main portion 45 of foot section, the integrated air system deflates bladders associated with foot section 44 to accommodate the shortening of foot section 44. In such embodiments, in response to extension 47 being extended relative to main portion 45, air bladders associated with foot section 44 are inflated by the integrated air system.

As also shown diagrammatically in FIG. 6, lift system 32 of bed 10 includes one or more elevation system motors or actuators 70, which in some embodiments, comprise linear actuators with electric motors. Thus, actuators 70 are sometimes referred to herein as motors 70. Alternative actuators or motors contemplated by this disclosure include hydraulic cylinders and pneumatic cylinders, for example. The motors 70 of lift system 32 are operable to raise, lower, and tilt upper frame 30 relative to base 28. In the illustrative embodiment, one of motors 70 is coupled to, and acts upon, a set of head end lift arms 78 and another of motors 70 is coupled to, and acts upon, a set of foot end lift arms 80 (only one of which can be seen in FIG. 1) to accomplish the raising, lowering and tilting functions of upper frame 30 relative to base 28. As bed 10 moves from the horizontal bed position of FIG. 1 to the chair egress position of FIG. 2, motors 70 are operated to move arms 78, 80 to lower upper frame 30 toward base 20 if frame 30 is in a raised position initially. In some embodiments, motors 70 are operated so as to tilt upper frame by a slight amount, e.g., by 2° to 5°, toward the reverse Trendelenburg position such that the foot end of upper frame 30 is slightly lower than the head end of frame 30.

Figure 3:
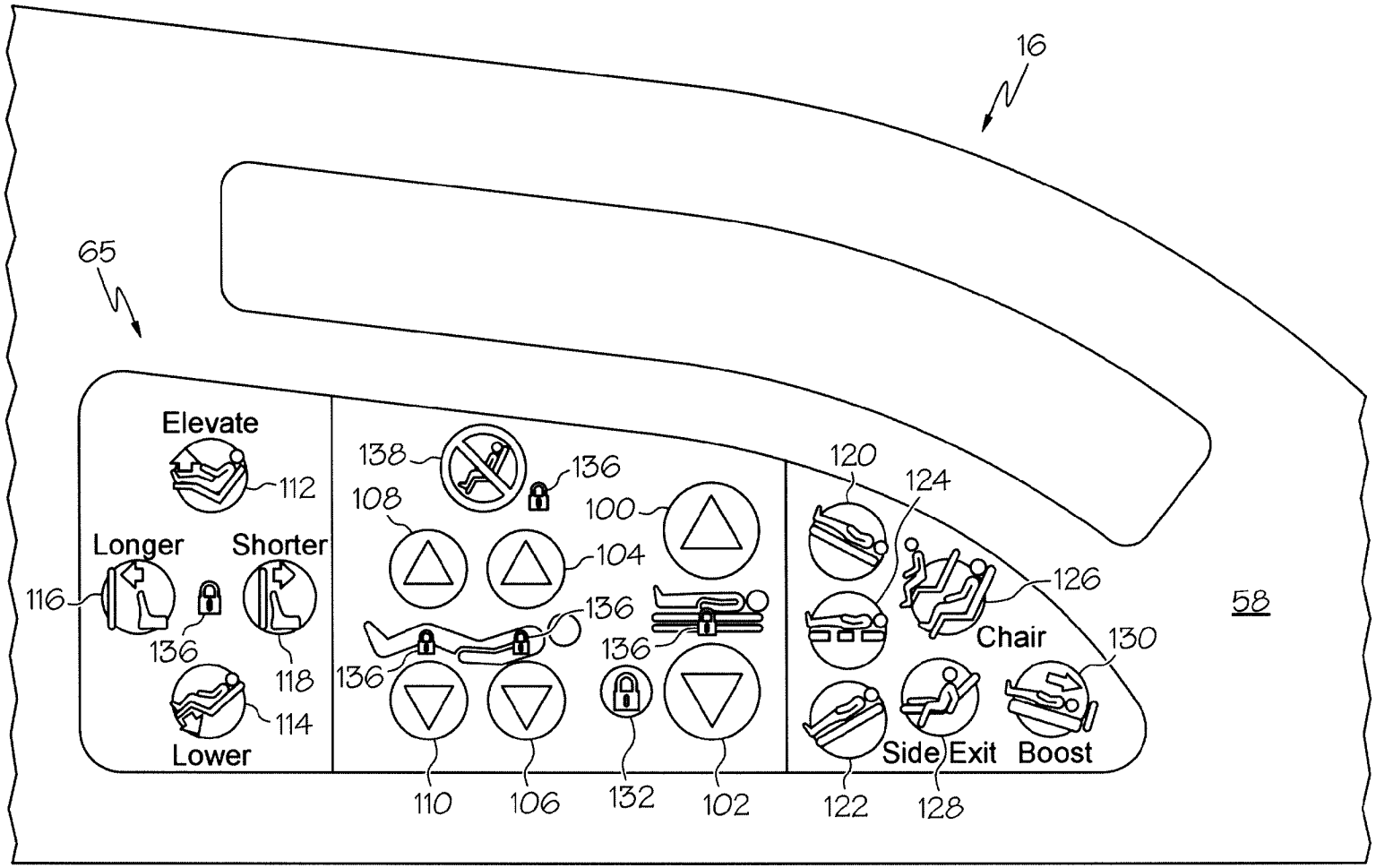
FIG. 3 is a side elevation view of a portion of a siderail of the hospital bed of FIGS. 1 and 2 showing a control panel of the siderail having a number of user input buttons that are pressed to control functions of the hospital bed, the user inputs including buttons capable of locking out the frame from moving into the chair egress position.

Referring now to FIG. 3, user interface 65 includes user inputs that are touched or pressed by a caregiver to operate motors 70, 90, 92, 94, 96. For example, user interface 65 includes an up button 100 that is used to command operation of motors 70 to raise upper frame 30 relative to base 28 and a down button 102 that is used to command operation of motors 70 to lower upper frame 30 relative to base 28. User interface 65 also includes a head up button 104 that is used to command operation of motor 90 to raise head section 40 relative to upper frame 30 and a head down button 106 that is used to command operation of motor 90 to lower head section 40 relative to upper frame 30.

User interface 65 includes a knee up button 108 that is used to command operation of motor 92 to raise thigh section 43 relative to upper frame 30 and a knee down button 110 that is used to command operation of motor 92 to lower thigh section 43 relative to upper frame 30. When thigh section 43 is raised or lowered, foot section 44 articulates relative to thigh section in those embodiments in which thigh section 43 and foot section 44 are pivotably coupled together. User interface 65 further includes a foot up or elevate button 112 that is used to command operation of motor 94 to raise foot section 44 relative to upper frame 30 and a foot down or lower button 114 that is used to command operation of motor 94 to lower foot section 44 relative to upper frame 30. User interface 65 also has a foot extension or longer button 116 that is used to command operation of motor 96 to extend extension 47 relative to main portion 45 of foot section 44 and a foot retraction or shorter button 118 that is used to command operation of motor 96 to retract extension 47 relative to main portion 45 of foot section 44.

Still referring to FIG. 3, user interface 65 includes a Trendelenburg button 120 that is used to command operation of motors 70 to tilt upper frame 30 into a Trendelenburg position having head end 24 of upper frame 30 lower in elevation than foot end 26 of upper frame 30 and a reverse Trendelenburg button 122 that is used to command operation of motor 70 and/or motor 72 to tilt upper frame 30 into a reverse Trendelenburg position having head end 24 of upper frame 30 higher in elevation than foot end 26 of upper frame 30. A horizontal button 124 is provided on user interface 65 and is used to command operation of motors 70 to return upper frame 30 to a horizontal position and to command operation of motors 90, 92, 94, 96 to return sections 40, 42, 43, 44 of deck 38 to the bed position. Button 124 is used, for example, after bed 10 has been placed in the chair egress position, the Trendelenburg position, or the reverse Trendelenburg position to return the upper frame 30 and deck 38 to a flat or horizontal position.

A chair button 126 is provided on user interface 65 and is used to command the operation of motors 70, 90, 92, 94, 96 to move upper frame 30 and sections 40, 42, 43, 44, including movement of extension 47, in the necessary manner to achieve the chair egress position. The manner in which each of motors 70, 90, 92, 94, 96 is operated for bed 10 to achieve the chair egress position is dependent upon the initial starting positions of upper frame 30 and deck sections 40, 42, 43, 44. For example, if upper frame is in a raised position and deck 38 is in a flat or horizontal position, then motors 70 are operated to lower upper frame 30 downwardly toward base and to tilt the upper frame slightly toward the reverse Trendelenburg position and motors 90, 92, 94, 96 are operated so as to raise head section 40, lower foot section 44, and to retract extension 47 relative to main portion 45 of foot section 44. Thus, in some instances, it may be necessary to operate all of motors 70, 90, 92, 94, 96 in order to move bed into the chair egress position and, in other instances, it may not be necessary to operate one or more of motors 70, 90, 92, 94, 96 in order to move bed 10 into the chair egress position.

In the illustrative example, user interface 65 includes a side exit button 128 that is pressed to lower upper frame 30 to a lowered position relative to base 28 and to raise head section 40 relative to upper frame 30 while moving thigh section 43 and foot section 44 into a horizontal position, or leaving thigh section 43 and foot section 44 in the horizontal position if those sections 43, 44 already occupy that position. In some embodiments, bed 10 includes an integrated air system that controls inflation and deflation of various air bladders or cells (not shown) of mattress 22 as mentioned above. In some such embodiments having an integrated air system, bladders associated with the seat and/or thigh sections 42, 43 are inflated in response to side exit button 128 being used.

Also in the illustrative example, user interface 65 has a boost button 130 which is used to move upper frame 30 into the Trendelenburg position and to increase inflation of all of the bladders of mattress 22. The boost button 130 is used primarily when a caregiver wishes to move a patient "up in bed" which means moving the patient back toward the head end 24 of bed 10. When head section 40 is raised to support a patient in a sitting up position and then is lowered to return the patient to a lying down position, the patient has a tendency to migrate toward the foot end 26 of the bed 10.

User interface 65 of bed 10 has a lockout button 132 that is used along with others of the buttons of user interface 65 to lockout or prevent the use of various motors 70, 90, 92, 94, 96. In some embodiments, after button 132 is pressed for a threshold amount of time, such as two seconds for example, a set of lockout icons 136 begin to flash. In some embodiments, a light such as a light emitting diode (LED) is situated behind each icon 136 and illuminates the icon 136 when the light is turned on. After icons 136 begin to flash, the user is able to stop pressing button 132 and has a threshold amount of time, such as five seconds, to do the following: press one of buttons 100, 102 to lockout elevation system motors 70; press one of buttons 104, 106 to lockout head motor 70; press one of buttons 108, 110 to lockout knee motor 92; or press one of buttons 112, 114, 116, 118 to lock out foot motor 94 and foot extension motor 96. In other embodiments, a user simultaneously presses button 132 and a selected one of buttons 100, 102, 104, 106, 108, 110, 112, 116, 118 to lock out the associated motor 70, 90, 92, 94 or motors 94, 96. Thus, in embodiments contemplated by this disclosure, one of the above processes or sequences is used to individually lockout motors 70, 90, 92, 94, 96.

According to this disclosure, user interface 65 includes a chair lockout button 138 that is used in conjunction with lockout button 132, either by first pressing button 132 for a threshold amount of time to cause icons 136 to flash and then pressing button 138 within a threshold amount of time thereafter or by simultaneously pressing buttons 132, 138 for a threshold amount of time, to lock out the ability of bed 10 to move into the chair egress position in response to use of chair button 126. Thus, chair lockout button 138 provides bed 10 with a chair lockout feature that prevents the combined and/or simultaneous operation of motors 70, 90, 92, 94, 96 to move bed 10 into the chair egress position.

In some embodiments, when the chair lockout feature is the only feature locked out, each of motors 70, 90, 92, 94, 96 is still able to be operated individually to perform its function. That is, even if chair lockout button 138 is used as described above to lockout movement of the bed 10 toward the chair egress position; buttons 100, 102 are still able to be used individually to operate elevation system motors 70 to raise and lower, respectively, upper frame 30 with respect to base 28; buttons 104, 106 are still able to be used individually to operate head motor 90 to raise and lower, respectively, head section 40 with respect to upper frame 30; buttons 108, 110 are still able to be used individually to operate knee motor 92 to raise and lower, respectively, thigh section 43 relative to upper frame 30; buttons 112, 114 are still able to be used individually to operate foot motor 94 to raise and lower, respectively foot section 44 relative to upper frame 30; and buttons 116, 118 are still able to be used individually to operate foot extension motor 96 to retract and extend, respectively, extension 47 relative to main portion 45 of foot section 44.

Of course, each of motors 70, 90, 92, 94, 96 can be locked out individually as described above. To give one example, if head motor 90 is locked out individually and the chair egress function is also locked out, then head section 40 will not move relative to upper frame 30 in response pressing any of buttons 104, 106, 126. In alternative embodiments, using the chair lockout button 138 to lockout the chair egress feature of bed 10 also locks out the individual use of all of motors 70, 90, 92, 94, 96. In such embodiments, all of icons 136 on user interface 65 become lit in response to use of chair lockout button 138 in conjunction with button 132 as described above.

It is believed that the chair lockout feature described above has not been implemented on any chair beds in the prior art. This feature is an improvement over the prior art because it eliminates the need to lock out multiple motors individually just to prevent the bed from being able to be moved into the chair egress position. Also, in some prior art beds, the head section may have been locked out individually, for example, because the patient was recovering from abdominal surgery, but pressing the chair button still resulted in the movement of the head section because that movement is part of the overall movement needed to place the bed in the chair egress position. That is, in such prior art beds, the head section could still move even if the head motor was locked out individually and there was no ability to lock out the chair egress function.

In the illustrative example, bed 10 has four foot pedals 84 coupled to base 28, a first of which is depressed to raise upper frame 30 relative to base 28, a second of which is used to lower frame 30 relative to base 28, a third of which is used to raise head section 40 relative to upper frame 30, and a fourth of which is used to lower head section 40 relative to upper frame 30. In other embodiments, foot pedals 84 are omitted. When motors 70 are locked out from use individually, the first and second pedals 84 just described are unable to be used to command operation of motors 70. Similarly, when motor 90 is locked out from use individually, the third and fourth pedals 84 just described are unable to be used to command operation of motor 90.

It is well known in the hospital bed art that electric drive motors with various types of transmission elements including lead screw drives and various types of mechanical linkages may be used to cause relative movement of portions of patient support apparatuses including raising, lowering, or tilting an upper frame of a bed relative to a base, which in some embodiments includes a lower frame that is covered at least partly by a shroud. It is also well known to use pneumatic or hydraulic actuators to actuate and/or move individual portions of patient support apparatuses. As a result, the term "lift system" or "elevation system" as used in the specification and in the claims, therefore, is intended to cover all types of mechanical, electromechanical, hydraulic and pneumatic mechanisms, including manual cranking mechanisms of all types, for raising or lowering or tilting portions of patient support apparatuses, such as illustrative hospital bed 10. Accordingly, the teachings of this disclosure are applicable to lift systems of all types. For example, lift systems using scissors linkage arrangements or using vertically oriented telescoping structures, such as hydraulic cylinders or jack screws, are within the scope of this disclosure.

Figure 4:
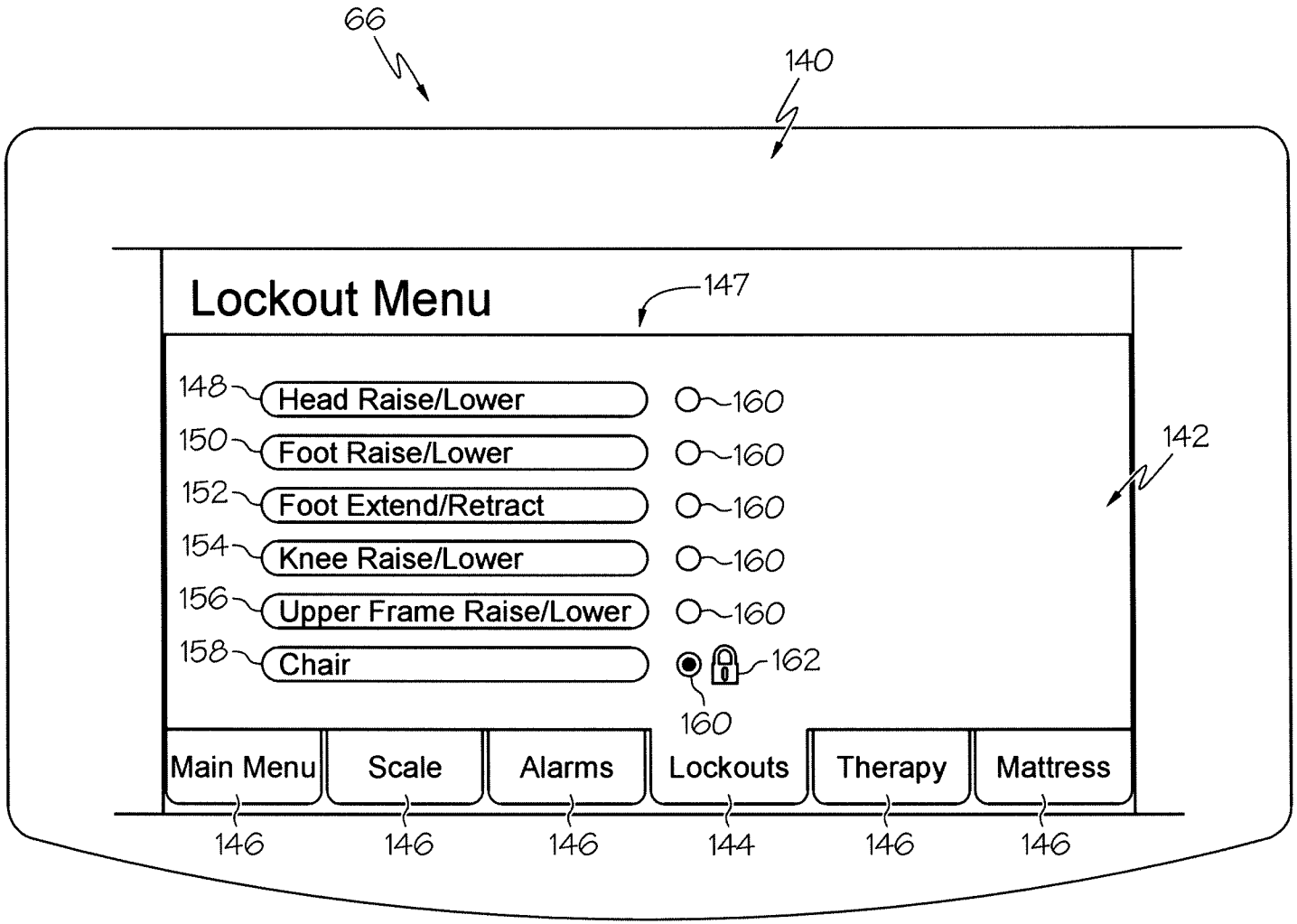
FIG. 4 is a side elevation view of a graphical user interface of the hospital bed of FIGS. 1 and 2 showing a Lockout Menu on a display screen of the graphical user interface.

One or more of the various buttons or user inputs 100-134 of user interface 65 comprise membrane switches in some embodiments including the illustrative embodiments. However, other types of switches or buttons such as toggle switches, snap switches, keys, keyboards, levers, sliders, knobs, and the like are considered suitable substitutes and are within the scope of the present disclosure. Alternatively or additionally, some or all of the various buttons 100-134 comprise icons or images on a graphical display screen. For example, as shown in FIG. 4, user interface 66 includes a housing 140 that carries a graphical display screen 140 that displays various screens used to control functions of bed 10. In FIG. 4, a lockout tab 144 has been selected from among a plurality of other tabs 146 which results in a lockout menu 147 being displayed on screen 140. Additional details about the functions associated with the screens corresponding to the other tabs 146 which, as shown in FIG. 4, have the text Main Menu, Scale, Alarms, Therapy, and Mattress (or Surface in some embodiments) appearing on respective tabs 146, can be found in U.S. Patent Application Publication No. 2008/0235872 A1 which is hereby expressly incorporated by reference herein.

Screen 142 is a touch screen in the illustrative example. Lockout menu 147 includes a Head Raise/Lower field 148, a Foot Raise/Lower field 150, a Foot Extend/Retract field 152, a Knee Raise/Lower field 154, an Upper Frame Raise/Lower field 156, and a Chair field 158. Each of fields 148, 150, 152, 154, 156, 158 is touched by a user to lockout the motor or motors 70, 90, 92, 94, 96 associated with the function indicated by the text or name of the respective field 148, 150, 152, 154, 156, 158. Thus, assuming that bed 10 is in an initial state having none of motors 70, 90, 92, 94, 96 locked out, touching field 148 results in head motor 90 being locked out from use, touching field 150 results in foot motor 94 being locked out from use, touching field 152 results in motor 96 being locked out from use, touching field 154 results in motor 92 being locked out from use, touching field 156 results in motors 70 being locked out from use, and touching field 158 results in the lock out of the combined and/or simultaneous operation of motors 70, 90, 92, 94, 96 to move bed 10 into the chair egress position.

In the illustrative example, after one of fields 148, 150, 152, 154, 156 158 is pressed to lock out the corresponding motor or motors 70, 90, 92, 94, 96, an associated radio button 160 becomes filled in and a lockout icon 162 appears on screen 142 next to the corresponding radio button 160 as shown in FIG. 4 with regard to the Chair lockout field 158. Thus, radio buttons 160 and icons 162 provide a user with a visual indication as to which bed functions are locked out and which ones aren't. In some embodiments, such as the illustrative embodiment, in which bed 10 has user interface 65 and user interface 66, when any of buttons 148, 150, 152, 154, 156, 158 are used on screen 142 of interface 66 to lock out an associated function, the corresponding lockout icon 136 is lit on user interface 65.

In other embodiments, one or the other of buttons 160 and icons 162 are omitted. Other scenarios for indicating which bed functions are locked out are within the scope of this disclosure. For example, fields 148, 150, 152, 154, 156, 158 may change from one color to another, e.g., from green to red, to indicate which functions are locked out. If a particular function associated with fields 148, 150, 152, 154, 156 is locked out, a subsequent touching of the associated field 148, 150, 152, 154, 156 will undo or unlock the locked out function. After a lockout is undone, the associated radio button 160 becomes empty and the associated icon 162 disappears from screen 142.

While user interfaces 65, 66, 166 are disclosed herein as being coupled to siderails 16, 18 of bed 10, it is within the scope of this disclosure for user interfaces 65, 66, 166 to be mounted to other portions of bed 10. For example, additionally or alternatively, one or more of user interfaces 65, 66, 166 are mounted to head board 46 and/or foot board 45 in other embodiments. In some embodiments contemplated herein, bed 10 omits interface 65 whereas in other contemplated embodiments of bed 10, user interface 66 is omitted. In some embodiments, housing 140 of user interface 66 is movable relative to the barrier to which it is coupled. For example, in some embodiments, housing 148 pivots and/or translates upwardly and downwardly relative to the associated barrier. Housing 168 of user interface 166 moves in a similar manner in some embodiments according to this disclosure. Various ways to couple user interface housings, such as housings 148, 168, to hospital beds are shown and described in U.S. Patent Application Publication No. 2007/0180616 A1 which is hereby expressly incorporated by reference herein.

Figure 5:
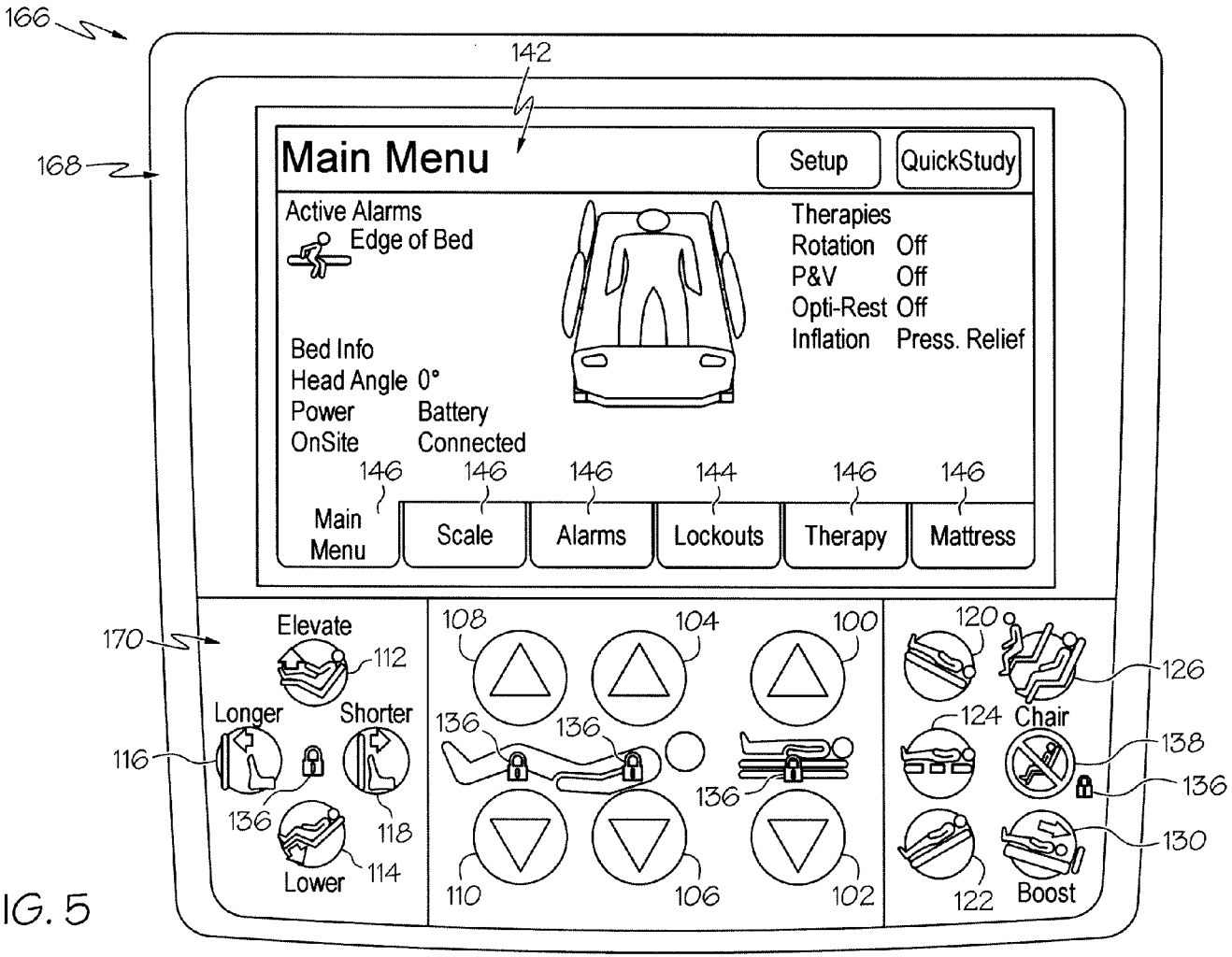
FIG. 5 is a side elevation view of an alternative embodiment user interface that includes a graphical user interface portion and a number of user input buttons beneath the graphical user interface portion.

Referring now to FIG. 5, an alternative embodiment user interface 166 includes a housing 168 that is larger than housing 140 of user interface 166 so as to accommodate graphical display screen 142 and a control panel 170 of manual buttons. Control panel 170 is situated beneath display screen 142 in the illustrative embodiment, but this need not be the case. The buttons on control panel 170 have the same functions as the buttons on user interface 65 and so like reference numbers are used to denote like buttons. However, there are a couple of exceptions; side exit button 128 and lockout button 132 of user interface 65 are omitted from control panel 170. However, in other embodiments, panel 170 includes buttons 128, 132 which are used to perform the same functions as described above in connection with user interface 65.

In the illustrative embodiment, a user simply presses Lockouts tab 146 on screen 142 of user interface 166 to access the same Lockout Menu 147 discussed above in connection with FIG. 4. Once the various lockout selections are made on the Lockout Menu 147, the corresponding lockout icons 136 on panel 170 become lit. Thus, in the illustrative example, chair lockout button 138 is not actually pressed to lock out the chair egress function because that function is locked out using field 158 of the lockout menu 147. Rather, button 138 serves as an icon that, when the corresponding lockout icon 136 is lit, provides a visual indication to a user that the chair egress function of the bed is locked out.

In alternative embodiments, button 138 is pressed to lock out the chair function. For example, in some contemplated embodiments, the screen associated with lockouts tab 146 does not have menu 147, but instead, simply has a field that is touched by user to activate, for a threshold amount of time, the ability to use buttons 100, 102, 104, 106, 108, 110, 112, 114, 116, 118, 138 to lock out the corresponding function. Thus, in such embodiments, the field that is accessible on screen 142 after tab 146 of user interface 166 is touched, serves a similar function as button 132 of user interface 65 described above in connection with FIG. 3. This field may include text such as "Activate Lock Outs" or simply "Lockout" or similar such explanatory text regarding the function associated with the field.

As shown diagrammatically in FIG. 6, bed 10 includes control circuitry 98 that is electrically coupled to motors 90, 92, 94, 96 and to motors 70 of lift system 32. Control circuitry 98 is represented diagrammatically as a single block 98 in FIG. 6, but control circuitry 98 in some embodiments comprises various circuit boards, electronics modules, and the like that are electrically and communicatively interconnected. Control circuitry 98 includes one or more microprocessors 172 or microcontrollers that execute software to perform the various control functions and algorithms described herein. Thus, circuitry 98 also includes memory 174 for storing software, variables, calculated values, and the like as is well known in the art.

As also shown diagrammatically in FIG. 6, a user inputs block represents the various user inputs such as buttons 100-136, for example, that are used by the caregiver or patient to communicate input signals to control circuitry 98 of bed 10 to command the operation of the various motors 70, 90, 92, 94, 96 of bed 10, as well as commanding the operation of other functions of bed 10. The chair lockout button or user input 138 is illustrated separately in FIG. 6 but is similarly electrically coupled to control circuitry 98. Of course, control circuitry 98 also receives user inputs commands from graphical display screen 142 in those embodiments of bed 10 having screen 142.

According to this disclosure, control circuitry of bed 10 communicates with a remote computer device 176 via communication infrastructure 178 such as an Ethernet of a healthcare facility in which bed 10 is located and via communications links 177, 179 as shown diagrammatically in FIG. 6. Computer device 176 is sometimes simply referred to as a "computer" herein. Remote computer 176 is part of an electronic medical records (EMR) system in some contemplated embodiments. Computer 176 is part of a nurse call system, a physician ordering system, an admission/discharge/transfer (ADT) system, or some other system used in a healthcare facility in other embodiments. Ethernet 178 in FIG. 6 is illustrated diagrammatically and is intended to represent all of the hardware and software that comprises a network of a healthcare facility.

In the illustrative embodiment, bed 10 has a communication interface or port 180 which provides bidirectional communication via link 179 with infrastructure 178 which, in turn, communicates bidirectionally with computer 176 via link 177. Link 179 is a wired communication link in some embodiments and is a wireless communications link in other embodiments. Thus, communications link 179, in some embodiments, comprises a cable that connects bed 10 to a wall mounted jack that is included as part of a bed interface unit (BIU) or a network interface unit (NIU) of the type shown and described in U.S. Pat. Nos. 7,538,659 and 7,319,386 and in U.S. Patent Application Publication Nos. 2009/0217080 A1, 2009/0212925 A1 and 2009/0212926 A1, each of which are hereby expressly incorporated by reference herein. In other embodiments, communications link 179 comprises wireless signals sent between bed 10 and a wireless interface unit of the type shown and described in U.S. Patent Application Publication No. 2007/0210917 A1 which is hereby expressly incorporated by reference herein. Communications link 177 comprises one or more wired links and/or wireless links as well.

In some embodiments, control circuitry 98 receives a message from computer 176 that includes information which indicates that the chair egress function of bed 10 should be locked out. For example, computer 176 of an EMR system sends a message to bed 10 to indicate that a patient has had, is having, or is going to have abdominal surgery, hip surgery, knee surgery, or some other type of surgery for which moving a patient into a chair egress position or sitting position is counterindicated or incompatible. In response to receiving such a message from computer 176, control circuitry 98 automatically locks out the chair egress function of bed 10 in some embodiments and automatically activates the associated lockout icons 136, 162 and radio button 160 to indicate that the chair egress function has been locked out. In other embodiments, in response to receiving such a message from computer 176, control circuitry displays a message on display screen 142 to prompt a caregiver to lock out the chair egress function in accordance with any of the ways for doing so as described herein.

Although certain illustrative embodiments have been described in detail above, many embodiments, variations and modifications are possible that are still within the scope and spirit of this disclosure as described herein and as defined in the following claims.

The invention claimed is:

1. A patient support apparatus comprising a frame, a mattress support deck coupled to the frame, the mattress support deck being movable between a horizontal position to support a patient in a lying position and a chair egress position to support the patient in a sitting position, at least one actuator coupled to the mattress support deck and operable to move the mattress support deck between the horizontal position and the chair egress position, and control circuitry coupled to the at least one actuator and operable to command operation of the at least one actuator, the control circuitry being operable to receive a chair lockout signal and, in response to receipt of the chair lockout signal, the control circuitry operating to prevent the at least one actuator from being operated to move the mattress support deck into the chair egress position, wherein the mattress support deck includes a head section and a foot section, the at least one actuator comprises a first actuator operable to move the head section and a second actuator operable to move the foot section, and receipt of the chair lockout signal by the control circuitry results in the control circuitry preventing simultaneous operation of the first and second actuators, wherein the first actuator and the second actuator are each operable individually even if the control circuitry has received the chair lockout signal unless the first and second actuators have been locked out individually.

2. The patient support apparatus of claim 1, further comprising a chair lockout user input, the chair lockout signal being sent to the control circuitry in response to use of the chair lockout user input by a user.

3. The patient support apparatus of claim 2, wherein the chair lockout user input comprises a button that is pressed by the user.

4. The patient support apparatus of claim 2, wherein the chair lockout user input comprises a membrane switch.

5. The patient support apparatus of claim 2, wherein the chair lockout user input comprises a field on a touch screen display.

6. The patient support apparatus of claim 2, further comprising a barrier coupled to one of the frame and the mattress support deck, the barrier inhibiting movement of a patient off of the patient support apparatus, and the chair lockout user input being coupled to the barrier.

7. The patient support apparatus of claim 6, wherein the barrier comprises one of a siderail, a head board, and a foot board.

8. The patient support apparatus of claim 1, wherein the chair lockout signal is sent to the control circuitry by a computer device located remotely from the patient support apparatus.

9. The patient support apparatus of claim 8, wherein the computer device is included as part of an electronic medical record (EMR) system.

10. The patient support apparatus of claim 1, wherein the control circuitry operates to prevent individual operation of the first actuator in response to receipt of a first lockout signal and the control circuitry operates to prevent individual operation of the second actuator in response to receipt of a second lockout signal.

11. The patient support apparatus of claim 10, further comprising a first lockout user input that is used to lockout the first actuator individually and a second lockout user input that is used to lockout the second actuator individually.

12. The patient support apparatus of claim 1, wherein the frame comprises a base, an upper frame above the base, and a lift system to raise and lower the upper frame relative to the base between a low position and a high position, wherein the lift system moves the upper frame to the low position in conjunction with the head section and foot section being moved during movement of the mattress support deck to the chair egress position, and the control circuitry also operating to prevent the lift system from moving the upper frame in conjunction with the head section and foot section when the control circuitry is locked out from moving the mattress support deck to the chair egress position.

13. A patient support apparatus comprising a frame, a mattress support deck coupled to the frame, the mattress support deck being movable between a horizontal position to support a patient in a lying position and a chair egress position to support the patient in a sitting position, at least one actuator coupled to the mattress support deck and operable to move the mattress support deck between the horizontal position and the chair egress position, and control circuitry coupled to the at least one actuator and operable to command operation of the at least one actuator, the control circuitry being operable to receive a chair lockout signal and, in response to receipt of the chair lockout signal, the control circuitry operating to prevent the at least one actuator from being operated to move the mattress support deck into the chair egress position, wherein the chair lockout signal is sent to the control circuitry by a computer device located remotely from the patient support apparatus, wherein the chair lockout signal is sent to the control circuitry automatically by the computer device in response to the computer device receiving information indicative of a patient condition that is incompatible with moving the patient into a sitting position.

14. The patient support apparatus of claim 13, wherein the information indicative of the patient condition comprises information indicating that the patient is having, is going to have, or has had, at least one of abdominal surgery, knee surgery, or hip surgery.

15. A patient support apparatus comprising a frame, a mattress support deck coupled to the frame, the mattress support deck being movable between a horizontal position to support a patient in a lying position and a chair egress position to support the patient in a sitting position, at least one actuator coupled to the mattress support deck and operable to move the mattress support deck between the horizontal position and the chair egress position, and control circuitry coupled to the at least one actuator and operable to command operation of the at least one actuator, the control circuitry being operable to receive a chair lockout signal and, in response to receipt of the chair lockout signal, the control circuitry operating to prevent the at least one actuator from being operated to move the mattress support deck into the chair egress position, wherein the frame comprises a base, an upper frame above the base, and a lift system to raise and lower the upper frame relative to the base between a low position and a high position, wherein the lift system moves the upper frame to the low position in conjunction with the head section and foot section being moved during movement of the mattress support deck to the chair egress position, and the control circuitry also operating to prevent the lift system from moving the upper frame in conjunction with the head section and foot section when the control circuitry is locked out from moving the mattress support deck to the chair egress position, wherein the lift system is operable individually even if the control circuitry has received the chair lockout signal unless the lift system has been locked out individually.

16. The patient support apparatus of claim 15, wherein the control circuitry operates to prevent individual operation of the lift system in response to receipt of a lift system lockout signal.

17. The patient support apparatus of claim 16, further comprising a lift system lockout user input that is used to lockout the lift system individually.

18. The patient support apparatus of claim 17, wherein the lift system includes a plurality of lift actuators and use of the lift system lockout user input results in the control circuitry locking out all of the plurality of lift actuators from individual operation.

* * * * *